US010178749B2

(12) United States Patent
Finn et al.

(10) Patent No.: US 10,178,749 B2
(45) Date of Patent: Jan. 8, 2019

(54) DC-DC ELECTRICAL TRANSFORMER

(71) Applicant: Tibbar Plasma Technologies, Inc., Los Alamos, NM (US)

(72) Inventors: John Finn, Los Alamos, NM (US); Cihan Akcay, Los Alamos, NM (US); Daniel Barnes, Lamy, NM (US); Juan Fernandez, Los Alamos, NM (US); William Gibson, Los Alamos, NM (US); Aaron McEvoy, Los Alamos, NM (US); Keith Moser, Libertyville, IL (US); Richard Nebel, Los Alamos, NM (US); Liviu Popa-Simil, Los Alamos, NM (US)

(73) Assignee: TIBBAR PLASMA TECHNOLOGIES, INC., Los Alamos, NM (US)

( * ) Notice: Subject to any disclaimer, the term of this patent is extended or adjusted under 35 U.S.C. 154(b) by 292 days.

(21) Appl. No.: 15/336,508

(22) Filed: Oct. 27, 2016

(65) Prior Publication Data

US 2018/0124907 A1 May 3, 2018

(51) Int. Cl.
*G05F 3/06* (2006.01)
*H05H 1/16* (2006.01)

(52) U.S. Cl.
CPC ..... *H05H 1/16* (2013.01)

(58) Field of Classification Search
CPC ..... H02M 7/02; H02M 7/40; H01J 37/3266; H01J 37/32697; H02K 44/06; H05H 1/16
USPC ..... 307/151
See application file for complete search history.

(56) References Cited

U.S. PATENT DOCUMENTS

| | | | |
|---|---|---|---|
| 3,530,334 | A | 9/1970 | Thorpe et al. |
| 4,041,353 | A | 8/1977 | Penfold et al. |
| 4,347,419 | A | 8/1982 | Jasper, Jr. |
| 5,476,501 | A | 12/1995 | Stewart et al. |
| 5,680,014 | A | 10/1997 | Miyamoto et al. |
| 5,917,286 | A | 6/1999 | Scholl et al. |

(Continued)

FOREIGN PATENT DOCUMENTS

| | | | |
|---|---|---|---|
| WO | 2006025626 | A1 | 3/2006 |
| WO | 2008140928 | A1 | 11/2008 |
| WO | 2014084963 | A1 | 6/2014 |

OTHER PUBLICATIONS

Aydemir, A.Y. et al., "Compressibility as a feature of field reversal maintenance in the reversed-field pinch," Physics of Fluids, Mar. 1985, pp. 898-902, vol. 28, No. 3, AIP Publishing, USA.

(Continued)

*Primary Examiner* — Carlos D Amaya

(57) ABSTRACT

An apparatus and corresponding systems and methods for managing electric power, particularly a transformer system and method, and more specifically a transformer for direct current. An example apparatus includes a chamber configured to contain plasma. The apparatus includes input electrodes disposed at least partially within the chamber, and configured to receive a first direct current input into the chamber. The input electrodes are configured to cause the input direct current to induce motion in the plasma. Motion induced in the plasma transforms current flowing therethrough. At output electrodes extend from the chamber. The output electrodes conduct a second direct current, from the induced motion in the plasma, for delivery from the chamber.

22 Claims, 9 Drawing Sheets

(56) References Cited

U.S. PATENT DOCUMENTS

| | | | |
|---|---|---|---|
| 6,095,084 | A | 8/2000 | Shamouilian et al. |
| 6,215,678 | B1 | 4/2001 | Titus et al. |
| 6,396,213 | B1 | 5/2002 | Koloc |
| 6,614,135 | B1 | 9/2003 | Clapham |
| 6,781,087 | B1 | 8/2004 | Chism, Jr. et al. |
| 7,232,985 | B2 | 6/2007 | Monkhorst et al. |
| 7,411,353 | B1 | 8/2008 | Rutberg et al. |
| 7,482,607 | B2 | 1/2009 | Lerner et al. |
| 7,511,246 | B2 | 3/2009 | Morrisoe |
| 7,741,577 | B2 | 6/2010 | Kong et al. |
| 7,808,353 | B1 | 10/2010 | Eskridge et al. |
| 8,031,824 | B2 | 10/2011 | Bystriskii et al. |
| 8,289,512 | B2 | 10/2012 | Morrisroe |
| 8,537,958 | B2 | 9/2013 | Laberge et al. |
| 8,622,735 | B2 | 1/2014 | Morrisroe |
| 8,878,434 | B2 | 11/2014 | Gilbert |
| 9,028,656 | B2 | 5/2015 | Koo et al. |
| 2004/0144314 | A1 | 7/2004 | David et al. |
| 2010/0068887 | A1 | 3/2010 | Harrington |
| 2010/0202580 | A1 | 8/2010 | Park et al. |
| 2011/0272386 | A1 | 11/2011 | Morrisroe |
| 2011/0273260 | A1 | 11/2011 | Morrisroe |
| 2011/0315867 | A1 | 12/2011 | Lane |
| 2015/0294842 | A1 | 10/2015 | Nebel |
| 2017/0027048 | A1 | 1/2017 | Nebel et al. |

OTHER PUBLICATIONS

Schnack, D. C. et al., "Numerical simulation of reversed-field pinch dynamics," Computer Physics Com., 1986, pp. 17-28, vol. 43, Amsterdam.

DC-DC ELECTRICAL TRANSFORMER

STATEMENT REGARDING FEDERALLY SPONSORED RESEARCH OR DEVELOPMENT

This invention was made with Government support under Award No. DE AR0000677, awarded by the Advanced Research Projects Agency—Energy (ARPA-E), U.S. Department of Energy. The Government has certain rights in this invention.

CROSS-REFERENCE TO RELATED APPLICATIONS

This application is related to U.S. patent application Ser. No. 15/209,907, filed 14 Jul. 2016, the entire disclosure of which is hereby incorporated by reference.

BACKGROUND OF THE INVENTION

A direct current to direct current (DC-DC) electrical transformer based on helical electrodes applied to a plasma is described hereinafter. In previously known devices (see, for example, U.S. Patent Application Publication No. 2015/0294842 by Nebel et al.) an input voltage is applied to the helical electrodes and an output is taken from electrodes at opposite the ends of the device. In the presently disclosed device, the secondary current is taken from a split electrode on one end of the device. The present disclosure, in contrast with known apparatuses and methods involving plasma-based transformers, also indicates methods of changing the output voltage and current relative to the input values, and also outlines a method of running the device in reverse in order to convert a stepup DC transformer to a stepdown DC transformer and vice-versa. Thus, this device can work as either a stepup or a stepdown transformer. Although conventional methods can provide long distance DC transmission, such methods are complex and costly. These and other shortcomings are addressed by the present disclosure.

SUMMARY OF THE INVENTIVE DISCLOSURE

It is to be understood that both the following summary and the following detailed description are exemplary and explanatory only and are not restrictive. Provided are methods and systems for, in one aspect, managing DC power. Provided are methods and systems for, in another aspect, transforming DC to DC power.

In an aspect, systems and methods of the present disclosure transform DC voltages and currents, while minimizing cost and complexity. In another aspect, instead of using wires and iron cores similar to known AC transformers, the DC to DC transformer systems of the present disclosure can comprise plasma, helical electrodes, and an axial magnetic field. As an example, the transformation of the DC voltages and currents can be based on magnetohydrodynamics (MHD) dynamo behavior.

In another aspect, an example system can comprise plasma disposed in a housing and two or more helical electrodes disposed in the housing, wherein an electric current passing through the two or more helical electrodes induces a rotation in the plasma. Conductive end caps can be coupled to the housing and the helical electrodes.

In yet another aspect, a method can comprise generating a magnetic field through plasma and generating a rotation in the plasma, thereby generating an electric current.

In another aspect, an example apparatus can comprise a chamber configured to contain plasma. The apparatus can comprise at least two input electrodes disposed at least partially within the chamber and configured to receive a direct current into the chamber. The at least two input electrodes can be configured to direct a first direct current to induce motion in the plasma. The apparatus can comprise at least two output electrodes extending from the chamber. The at least two output electrodes can be configured to conduct a second DC current from the chamber based on the induced motion in the plasma. If two or more output electrodes are used, a transformed DC current can be conducted from the chamber.

In another aspect, an example method can comprise conveying a first direct current into a chamber, inducing motion in plasma contained in the chamber based on the direct current, and receiving a second direct current from the chamber based on the induced motion of the plasma.

In another aspect, an example system can comprise a transformer with high efficiency by including one or more insulating slots in the output electrodes. The insulating slots divide the output electrode into functional segments, prevent the cancellation of output voltages and currents, and allow for the possibility of combining the outputs from the output segments either in series or in parallel.

In another aspect, the pitch of the helical electrodes may be varied to optimize the efficiency of the transformer.

In another aspect, the length of the apparatus' chamber will be varied to optimize the efficiency of the transformer, and to determine the ratio of the output voltage of the second current to the output of the first, input, voltage.

In another aspect, the apparatus may be configured to be operated in reverse, with input (first) DC voltage applied at the split electrodes, and with the second (output) DC current conveyed off by the helical electrodes. This reciprocal or reverse operational mode can be optimized with respect to the pitch of the helical electrodes and the length of the plasma.

Additional advantages will be set forth in part in the description which follows or may be learned by practice. The advantages of the present invention can be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

The accompanying drawings, which are incorporated in and constitute a part of this specification, illustrate embodiments and together with the description, serve to explain the principles of the methods and systems.

Figure 1A:
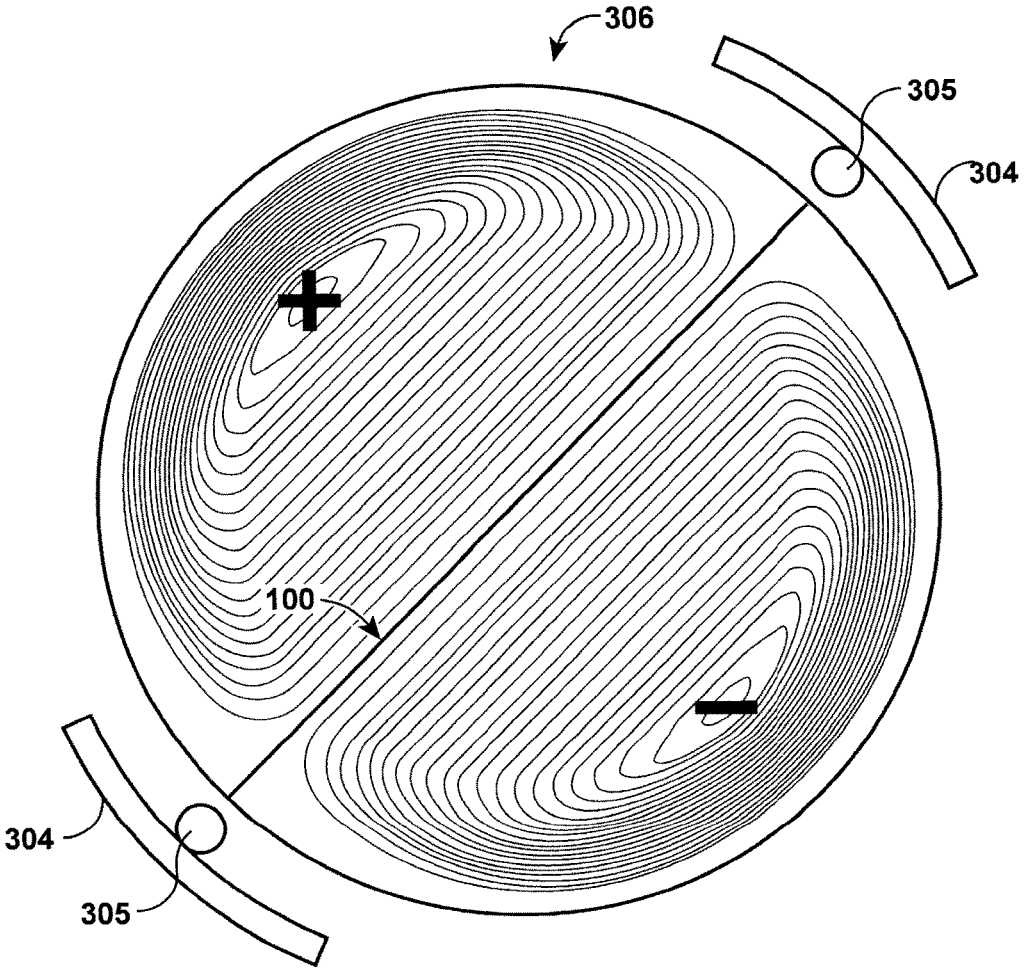
FIG. 1A is a diagrammatic sectional view of axial current density superposed on a split electrode configured to produce DC power in a system according to the present invention.

The various views are not necessarily to scale, either within a particular view or between views.

DETAILED DESCRIPTION OF EMBODIMENTS

Before the present methods and systems are disclosed and described, it is to be understood that the methods and systems are not limited to specific synthetic methods, specific components, or to particular compositions. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Herein disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this disclosure including, but not limited to, steps in disclosed methods. Thus, if there are a variety of additional steps that can be performed, it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following descriptions.

As will be appreciated by one skilled in the art, the methods and systems disclosed herein, and sub-methods and subsystems, may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software routines and algorithms. Any suitable computer-readable storage medium may be utilized including hard disks, CD-ROMs, optical storage devices, or magnetic storage devices.

Embodiments of the methods and systems are described below with reference to block diagrams and flowchart illustrations of methods, systems, apparatuses and computer program products. It is understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

The computer program instructions according to this disclosure may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus, to produce a computer-implemented process such that the instructions that are executed on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and methods, and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

The systems and methods of the present disclosure generally involve inducing a flow in plasma, and exploiting the plasma flow to realize a current transformation or conversion. Flows can be induced in plasmas by applying an electric field perpendicular to the magnetic field. The ideal MHD Ohm's law can be written as:

$$E+VxB=0, \quad (1)$$

where E is the local electric field, V is the local plasma velocity, and B is the local magnetic field, and x signifies the vector cross product. Bold face indicates quantities which are vectors.

If equation (1) is crossed with the magnetic field B, it can be determined that the plasma flow perpendicular to the magnetic field (denoted as $V_{ExB}$ and commonly referred to as the ExB drift velocity) becomes:

$$V_{ExB}=(ExB)/B^2, \quad (2)$$

Where x signifies the vector cross product and $B^2$ is the vector dot product of B with itself.

In order for the ExB drift velocity to significantly change the magnetic field it must be comparable to the Alfven speed ($V_A$) which can be expressed as:

$$V_A=B/(\mu_0\rho)^{1/2}, \quad (3)$$

where B is the magnitude of the magnetic field, p is the mass per unit volume, and $\mu_0$ is the permittivity of free space. Equation (1) can be combined with Faraday's law:

$$\partial B/\partial t=-\mathrm{curl}(E) \quad (4)$$

and integrated over a surface. As such, the result calculation provides that the magnetic field lines (or the magnetic flux) are substantially frozen into the plasma. As an example, the magnetic field lines convect with the plasma.

When plasma velocities approach the Alfven speed ($V_A$), the plasma velocities can bend the magnetic field lines. Thus, if a velocity shear is induced in the perpendicular velocity (e.g., the $V_{ExB}$ drift velocity) along a magnetic field line, the magnetic field can be significantly modified (provided that the flow speeds are near the Alfven speed ($V_A$).

Three-dimensional nonlinear plasma simulations (resistive magnetohydrodynamics (MHD)) can be used to confirm aspects of the phenomenon described herein above. As an example, a simulation code similar to that implemented in A. Y. Aydemir, D. C. Barnes, E. J. Caramana, A. A. Mirin, R. A. Nebel, D. D. Schnack, A. G. Sgro, *Phys Fluids* 28, 898 (1985) and D. D. Schnack, D. C. Barnes, Z. Mikic, D. S. flamed, E. J. Caramana, R. A. Nebel, *Computer Phys Comm* 43, 17 (1986), can be used. As a further example, plasma can be simulated in cylindrical geometry.

In an aspect, an axial magnetic field can be applied along a helical electric field (e.g., provided via a pair of helical electrodes on the boundary). Such simulations can be plotted as current contours, as shown in FIG. 1A.

The $J_z$ value that is plotted is defined as:

$$\mu_0 J_z=[\mathrm{curl}(B)]_z, \quad (5)$$

where $J_z$ is the axial current density.

As illustrated in FIG. 1A, the $J_z$ contours produced by the MEM simulations can be superposed on a split electrode, labeled as 306. The electrode according to the disclosed apparatus and method can be split into two pieces, separated by at least one insulator labeled in FIG. 1A as insulator 100. The location and shape of the two segments of the electrode 306 in this embodiment can be determined by MHD simulations. The component configuration shown in FIG. 1A is used to convert a first DC to a second DC. The helical electrodes, which in the preferred embodiment serve as the input electrodes, are labeled as 304. The connector leads are labeled as 305. The plasma produces two helically symmetric axial currents that travel in opposite directions, labeled + and − in the FIG. 1A. The apparatus's endcaps, seen as components labeled 306 and 307 in FIGS. 2, 3A, and 3B, can be electrically connected either in series or in parallel, causing either the voltages or the currents to add, respectively. In another aspect, one of the endcap electrodes 306 or 307 can be slotted with an intervening insulator between two endcap segments, while the second endcap is a solid conductor. In this embodiment, current flows out of one segment of the first endcap, through the plasma in the chamber to the second endcap, through the integral second endcap, and then back through the plasma and into the second segment of the first endcap, thereby providing voltage in series.

Figure 1B:
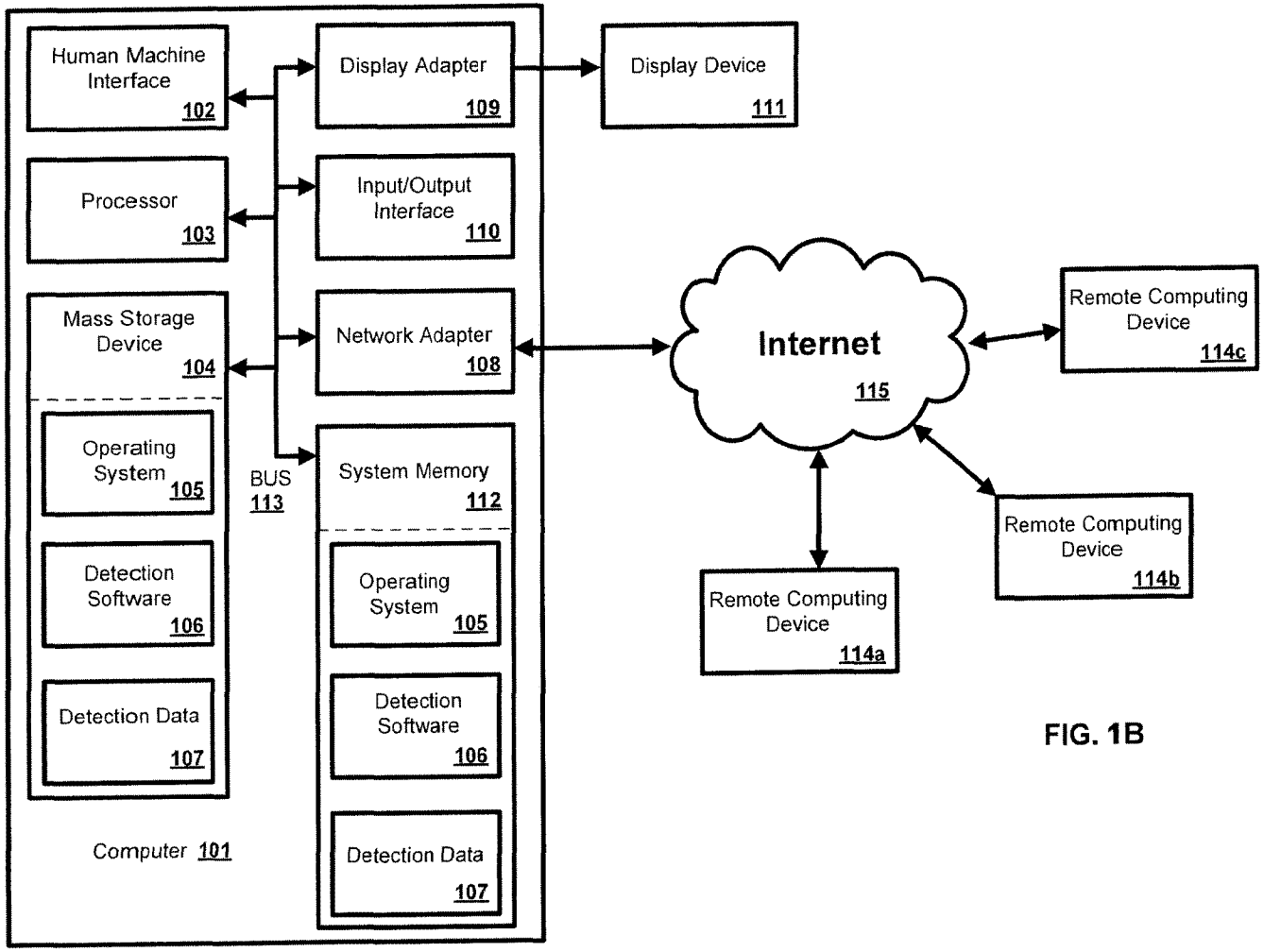
FIG. 1B is a block diagram of an exemplary computing device in accordance with the present invention.

FIG. 1B is a block diagram illustrating an exemplary operating environment for performing the disclosed methods. This exemplary operating environment is only an example of an operating environment and is not intended to suggest any limitation as to the scope of use or functionality of operating environment architecture. Neither should the operating environment be interpreted as having any dependency or requirement relating to any one or combination of components illustrated in the exemplary operating environment.

The present methods and systems can be operational with numerous other general purpose or special purpose computing system environments or configurations. Examples of well known computing systems, environments, and/or configurations that can be suitable for use with the systems and methods comprise, but are not limited to, dynamos, personal computers, server computers, laptop devices, and multiprocessor systems. Additional examples comprise set top boxes, programmable consumer electronics, network PCs, minicomputers, mainframe computers, distributed computing environments that comprise any of the above systems or devices, and the like.

The processing of the disclosed methods and systems can be performed by software components. The disclosed systems and methods can be described in the general context of computer-executable instructions, such as program modules, being executed by one or more computers or other devices. Generally, program modules comprise computer code, routines, programs, objects, components, data structures, etc., that perform particular tasks or implement particular abstract data types. The disclosed methods can also be practiced in grid-based and distributed computing environments where tasks are performed by remote processing devices that are linked through a communications network. In a distributed computing environment, program modules can be located in both local and remote computer storage media including memory storage devices.

With attention invited to FIG. 1B, one skilled in the art will appreciate that the systems and methods disclosed herein can be implemented via a general-purpose computing device in the form of a computer 101. The components of the computer 101 can comprise, but are not limited to, one or more processors or processing units 103, a system memory 112, and a system bus 113 that couples various system components including the processor 103 to the system memory 112. In the case of multiple processing units 103, the system can utilize parallel computing.

The system bus 113 represents one or more of several possible types of bus structures, including a memory bus or memory controller, a peripheral bus, an accelerated graphics port, and a processor or local bus using any of a variety of bus architectures. By way of example, such architectures can comprise an Industry Standard Architecture (ISA) bus, a Micro Channel Architecture (MCA) bus, an Enhanced ISA (EISA) bus, a Video Electronics Standards Association (VESA) local bus, an Accelerated Graphics Port (AGP) bus, and a Peripheral Component Interconnects (PCI), a PCI-Express bus, a Personal Computer Memory Card Industry Association (PCMCIA), Universal Serial Bus (USB) and the like. The bus 113, and all buses specified in this description can also be implemented over a wired or wireless network connection and each of the subsystems, including the processor 103, a mass storage device 104, an operating system 105, detection software 106, detection data 107, a network adapter 108, system memory 112, an Input/Output Interface 110, a display adapter 109, a display device 111, and a human machine interface 102, can be contained within one or more remote computing devices 114*a,b,c* at physically separate locations, connected through buses of this form, in effect implementing a fully distributed system.

The computer 101 typically comprises a variety of computer readable media. Exemplary readable media can be any available media that is accessible by the computer 101 and comprises, for example and not meant to be limiting, both volatile and non-volatile media, removable and non-removable media. The system memory 112 comprises computer readable media in the form of volatile memory, such as random access memory (RAM), and/or non-volatile memory, such as read only memory (ROM). The system memory 112 typically contains data such as detection data 107 and/or program modules such as operating system 105 and detection software 106 that are immediately accessible to and/or are presently operated on by the processing unit 103.

The computer 101 may also comprise other removable/non-removable, volatile/non-volatile computer storage media. By way of example, FIG. 1B illustrates a mass storage device 104 which can provide non-volatile storage of computer code, computer readable instructions, data structures, program modules, and other data for the computer 101. For example and not meant to be limiting, a mass storage device 104 can be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Optionally, any number of program modules can be stored on the mass storage device 104, including by way of example, an operating system 105 and detection software 106. Each of the operating system 105 and detection software 106 (or some combination thereof) can comprise elements of the programming and the detection software 106. Detection data 107 can also be stored on the mass storage device 104. Detection data 107 can be stored in any of one or more databases known in the art. Examples of such databases comprise, DB2®, Microsoft® Access, Microsoft® SQL Server, Oracle®, mySQL, PostgreSQL, and the like. The databases can be centralized or distributed across multiple systems.

A user can enter commands and information into the computer 101 via an input device (not shown). Examples of known such input devices comprise, but are not limited to, a keyboard, pointing device (e.g., a "mouse"), a microphone, a joystick, a scanner, tactile input devices such as gloves, and other body coverings, and the like These and other input devices can be connected to the processing unit 103 via a human machine interface 102 that is coupled to the system bus 113, but can be connected by other interface and bus structures, such as a parallel port, game port, an IEEE 1394 Port (also known as a Firewire port), a serial port, or a universal serial bus (USB).

A display device 111 can also be connected to the system bus 113 via an interface, such as a display adapter 109. It is contemplated that the computer 101 can have more than one display adapter 109 and the computer 101 can have more than one display device 111. For example, a display device can be a monitor, an LCD (Liquid Crystal Display), or a projector. In addition to the display device 111, other output peripheral devices can comprise components such as speakers (not shown) and a printer (not shown) which can be connected to the computer 101 via Input/Output Interface 110. Any step and/or result of the methods can be output in any form to an output device. Such output can be any form of visual representation, including, but not limited to, textual, graphical, animation, audio, tactile, and the like.

The computer 101 can operate in a networked environment using logical connections to one or more remote computing devices 114*a,b,c*. By way of example, a remote computing device can be a personal computer, portable computer, a server, a router, a network computer, a peer device or other common network node, and so on. Logical connections between the computer 101 and a remote computing device 114*a,b,c* can be made via a local area network (LAN) and a general wide area network (WAN). Such network connections can be through a network adapter 108. A network adapter 108 can be implemented in both wired and wireless environments. Such networking environments are conventional and commonplace in offices, enterprise-wide computer networks, intranets, and the Internet 115.

For purposes of illustration, application programs and other executable program components such as the operating system 105 are illustrated herein, particularly with reference to FIG. 1B, as discrete blocks, although it is recognized that such programs and components reside at various times in different storage components of the computing device 101, and are executed by the data processor(s) of the computer. An implementation of simulation software 106 can be stored on or transmitted across some form of computer readable media. Any of the disclosed methods can be performed by computer readable instructions embodied on computer readable media. Computer readable media can be any available media that can be accessed by a computer. By way of example and not meant to be limiting, computer readable media can comprise "computer storage media" and "communications media." "Computer storage media" comprise volatile and non-volatile, removable and non-removable media implemented in any methods or technology for storage of information such as computer readable instructions, data structures, program modules, or other data. Exemplary computer storage media comprises, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

Figure 2:
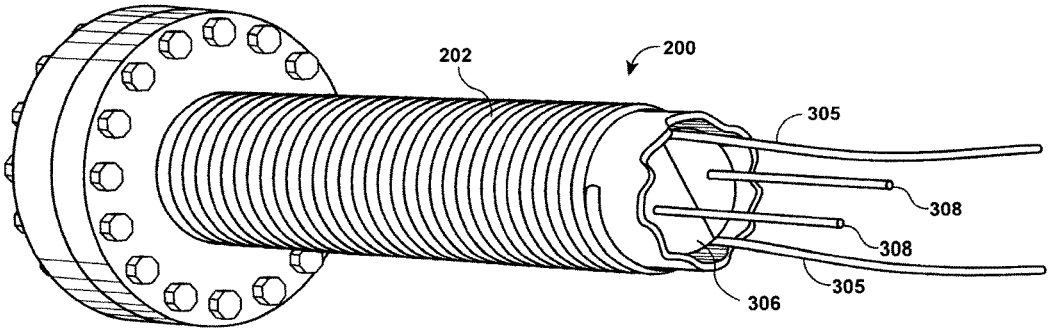
FIG. 2 is a perspective view of an exemplary transformer system according to the present invention.

FIG. 2 illustrates a cylindrical vacuum chamber 200 of a transformer system according to the present disclosure. This a chamber is configured to contain a plasma; plasma (not shown) can be disposed in the chamber 200. As an example, a conductor 202 (e.g., wire) can be disposed around a periphery of the housing forming the chamber 200. As a further example, wire conductor 202 can be wound about the chamber 200 to define a solenoid that provides an axial magnetic field when current flows through the conductor. Accordingly, the solenoid is disposed around at least a portion of an external wall of the chamber 200; electric current passing through the solenoid induces a magnetic field within the chamber in an axial direction of the solenoid, generally in accordance with long-known principles.

There are provided at least two input electrodes disposed at least partially within the chamber and configured to receive a first direct current into the chamber; the at least two input electrodes are configured to cause the first direct current to induce motion in the plasma. There also are provided at least two output electrodes extending from the chamber, and the at least two output electrodes are configured to receive or convey a second direct current from the chamber. The voltage or current of the second current outputted from the chamber results from and is based upon the induced motion in the plasma. In a preferred embodiment, the input electrodes are helical electrodes 304 seen in FIG. 3B, which are in signal communication with the leads 305, while the output electrodes are the split endcap 306 transmitting to its associated leads 308. In one possible alternative embodiment however, the electrode functions may be reversed, with the output electrodes being the helical electrodes 304, and the input electrodes being the split endcap 306.

Figure 4:
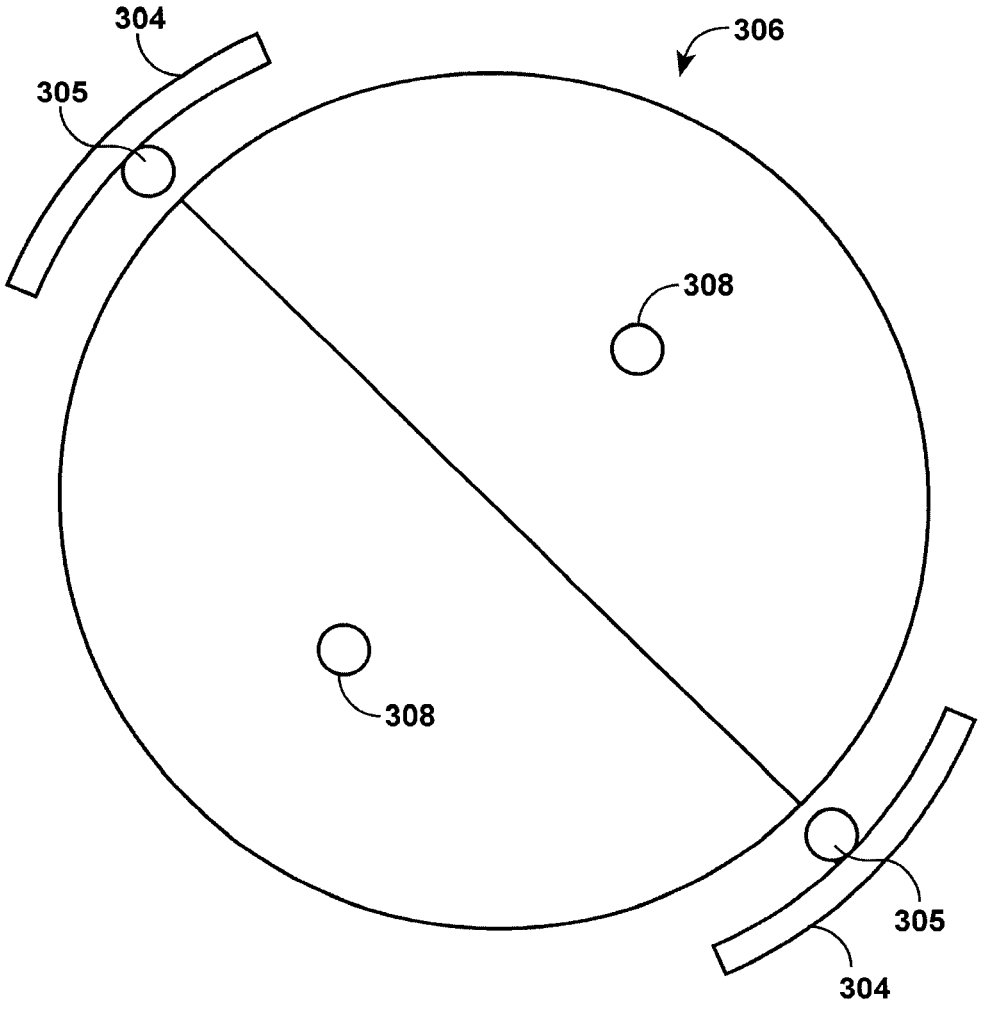
FIG. 4 is an axial view of a split electrode configured to produce DC power according to the present invention.

Preferably, and as suggested by FIGS. 1A and 4, the input electrodes preferably are within the chamber 200, disposed on its inside wall. The input electrodes, particularly the helical electrodes 304, are equally spaced around the chamber circumference; i.e., two input electrodes are separated by 180 degrees. There preferably are at least two sets of electrodes, with an associated pair of electrodes constituting a pair, and electrode sets likewise are equally spaced around the chamber. Spacing of adjacent input electrodes is equidistant, such that adjacent helical electrodes preferably are topologically parallel to one another. In an alternative embodiment, the input voltages 308 are applied to the split electrodes 306, and output DC voltages and currents are conveyed from the chamber via the leads connected to the helical electrodes 305.

Figure 3A:
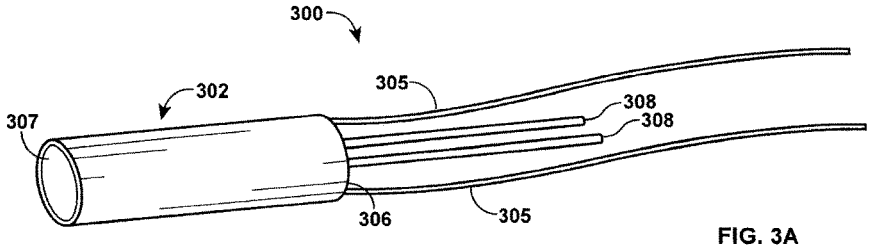
FIG. 3A is a perspective view of an exemplary transformer assembly.
Figure 3B:
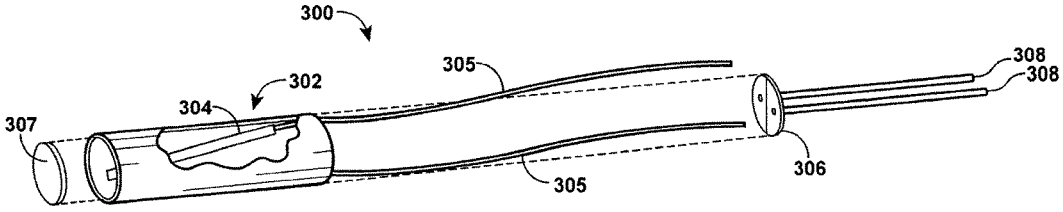
FIG. 3B is an exploded perspective view of an exemplary transformer assembly.

FIG. 3A and FIG. 3B illustrate a transformer assembly 300 in accordance with the disclosed system and method. The transformer assembly comprises a housing 302 having two or more helical electrodes 304 (only one shown in FIG. 3B; a paired set is seen in FIGS. 1A and 4) disposed therein and/or extending there from. As an example, the electrodes 304 can be disposed in the chamber 200 of FIG. 2; that is, the chamber 300 of FIGS. 3A-B in at least one embodiment is analogous to the chamber 200. As shown, the electrodes 304 are helically wound within the chamber and preferably have a 10:1 twist (e.g., the electrodes travel 10 times as far in the axial direction as they do in the poloidal (azimuthal) direction). Other twists can be used and ratios can be used. For example, twists can range from about 1:50 to about 1:1 axial to poloidal ratio. The electrodes 304 serve preferably as the primary for the transformer system. Voltage and current can be applied across the electrodes 304, for example, via leads 305. Accordingly, the applied electric field is perpendicular to the applied magnetic field from conductor 202 shown in FIG. 2. In an alternative embodiment, the operational functions may be reversed, in accordance with general principles known in the art, so that input is supplied to the endcap electrodes 306 and output is via the helical electrodes 304. In these embodiments, the applied electric field is parallel to the magnetic field.

The input electrodes 304 when actuated thus induce rotation in the plasma via the ExB drift. Because the electrodes 304 are helical in configuration and arrangement relative to the axis of the chamber 300, this rotation is sheared in the axial direction. The result is that the magnetic field lines are bent, and an axial current is induced within the chamber. In an alternative embodiment, the parallel current from the single slotted endcap electrode leads 308 drives kinking behavior in the plasma, which causes strong helical flows and drives current perpendicular to the magnetic field and into the helical electrodes 304. Thus, the magnetic field is caused by the induced motion to align at least in part with magnetic fields caused by at least some portion of the at least two input electrodes, thereby inducing the direct current within the chamber 300.

The housing 302 can be formed from ceramic or electrical insulators such as plastic or composite materials. The end caps 306 and 307 preferably are disposed at opposite ends of the housing 302. First endcap 306 is the split electrode with insulation, as seen in FIG. 1A. In the depicted embodiment, endcap 307 is a solid electrode. In an aspect of this embodiment, the second current output is through the leads connected to the split or slotted end cap 306, forming the secondary of the transformer. The end caps 306 and 307 preferably are conductive and are capable of capturing the voltage and current that is generated parallel to the magnetic field. It is seen, therefore, that in one preferred embodiment, the housing 302 includes an end cap 307 and a split electrode 306 at opposite ends of the chamber, and all output electrodes 308 of the at least two output electrodes are disposed through the split electrode 306.

In a possible alternative embodiment, both endcaps 306 and 307 are slotted (e.g., in the manner seen in FIG. 1A, with insulators and the voltages and currents are taken off in either series or in parallel. In another possible aspect, the input DC voltage and first current are supplied to the slotted endcap electrode leads 308, and the output DC voltage and second current is taken from the transformer assembly via the helical electrode leads 305. It thus is understood that alternative versions of the apparatus may feature split end cap electrodes, similar to electrode 306, at both ends of the chamber 300. In such an embodiment, the output leads of the at least two output electrodes are disposed through these split electrodes.

Reference is made to FIG. 4, which illustrates the axial outside of the split electrode shown in FIG. 1A and in FIGS. 3A-3B. The split output electrode is labeled as 306, and the leads for the secondary are labeled as 308. The primary electrodes 304 and their leads 305 are also shown. In an alternative mode of operation, the transformer primary (input) includes electrode 306 and leads 308, and the transformer secondary (output) comprises the electrodes 304 (e.g., helical electrodes) and their associated leads 305.

Figure 5:
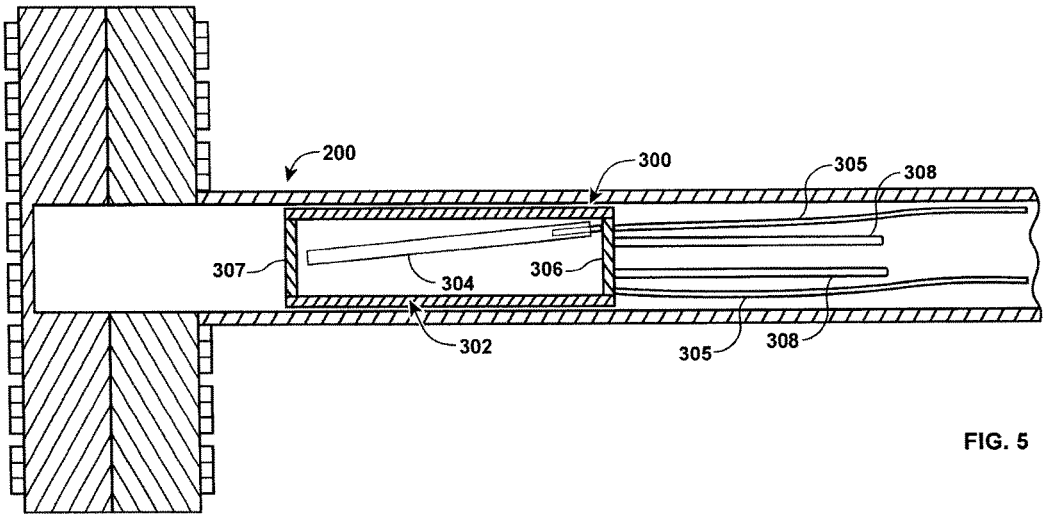
FIG. 5 is a cross-section view of an exemplary transformer system.

As shown in FIG. 5, the transformer assembly 300 of FIGS. 3A-3B in a preferred embodiment may be disposed in a vacuum chamber such as the vacuum chamber 200 of FIG. 2. In another aspect, the helical electrodes 304, which are within and/or extending from the housing 302, are powered by a first electric current. A conductor carries the second current from the end cap 306, and constitutes the secondary of the transformer assembly. Two or more terminals 308 can be coupled to the end caps 306 to allow the secondary current to be transmitted to a remote location for use. In the oppositely functional embodiment, the endcap electrodes 306 form the primary of the transformer, and are powered by the first electrical direct current, and the direct current carried through the plasma to the helical electrodes 304 is conveyed from the secondary.

Figure 6:
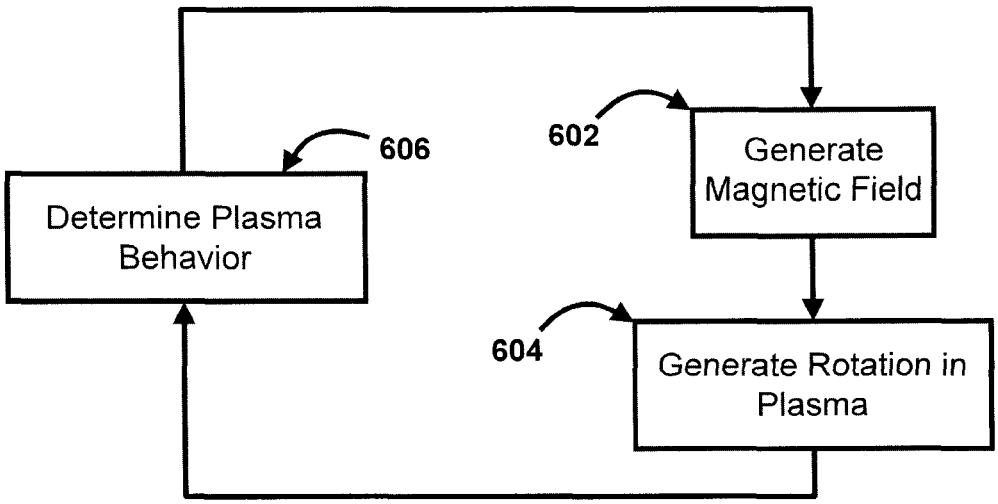
FIG. 6 is a flow diagram of an exemplary method.

The flowchart of FIG. 6 illustrates that a method according to this disclosure can comprise generating a magnetic field through a plasma (step 602) and generating a rotation in the plasma (step 604), thereby generating an electric current. The magnetic field can be generated by a solenoid assembly. As an example, the solenoid assembly can be disposed around the plasma, such as a solenoid housing. In an aspect, the rotation can be sheared in an axial direction relative to the plasma, and the current is generated in the plasma in the axial direction. A drift speed of the plasma is a factor (e.g., fraction or multiple) of the Alfven Speed. For example, the drift speed of the plasma can be between about 0.01 and about 400 times the Alfven speed. As a further example, the drift speed can be between about 0.01 and about two times the Alfven speed, preferably about one times of the Alfven Speed, such the drift speed and the Alfven speed approximate each other. Other possible ratios between drift speed and Alfven Speed, according to the present disclosure, are between about 0.01 and about 10 times the Alfven speed, between about 0.01 and about 100 times the Alfven speed, between about 0.01 and about 200 times, or between about 0.01 and about 300 times the Alfven speed. Other ranges of factors can result from the systems and methods of the present disclosure.

In another aspect, generating a rotation in the plasma comprises generating one or more of a partial laminar flow and a turbulent flow in the plasma. In a further aspect, plasma behavior can be determined (e.g., estimated, simulated) using an MHD simulation (step 606). Accordingly, the magnetic field and rotation generated can be configured based on the MHD simulation. This diagram applies to another aspect, in which the voltage is applied to the endcaps. This voltage through the slotted electrodes causes current in the plasma with a helical or kinked magnetic field, and generates rotation.

Figure 7:
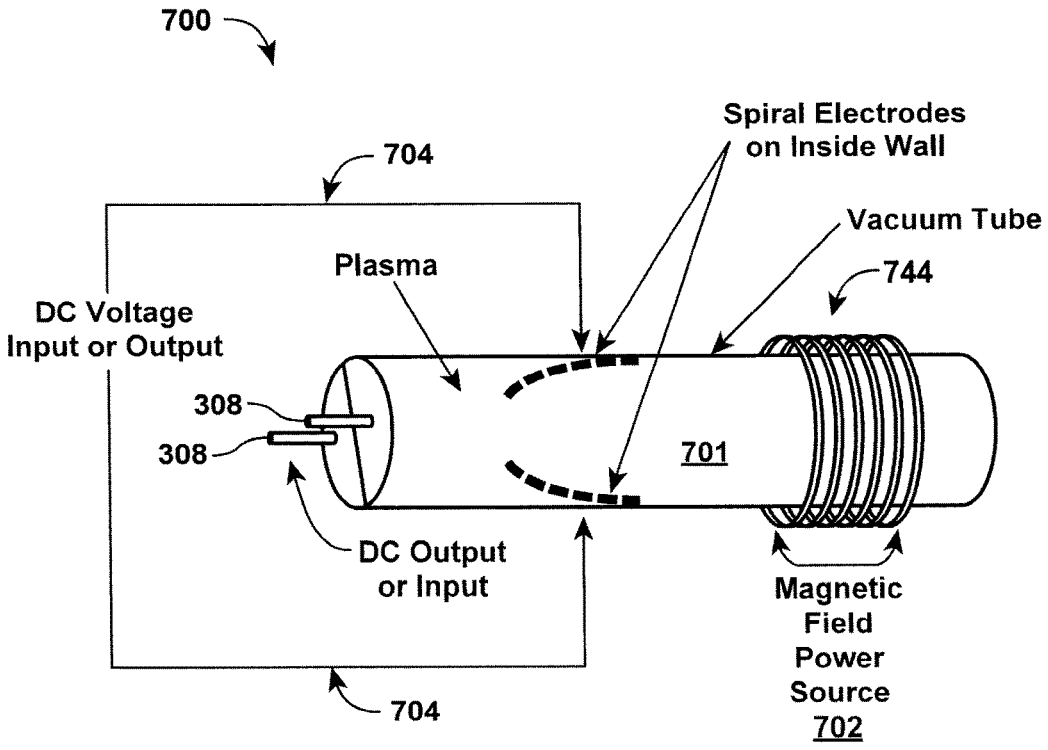
FIG. 7 is a conceptual diagram illustrating an exemplary split electrode system to produce DC power according to the present invention.

FIG. 7 is a schematic of the transformer 700. The externally supplied magnetic field is from a magnetic field power source 702 wound around a vacuum tube 701. The helical, or spiral, electrodes (e.g., 304 in FIG. 5) provide DC voltage 704 to ionize to the gas in the plasma in the tube chamber 701, and provide a current perpendicular to the magnetic field. The DC output voltage and current is through the electrode leads 308. In an alternative embodiment, the input voltage is applied at the leads 308 to the endcaps, ionizing the plasma and driving current, and the output is from the leads to the helical electrodes 704.

In one embodiment, the second endcap electrode (not shown in FIG. 7, but corresponding to endcap 307 in FIGS. 3A and 5) is solid. In another embodiment, this second endcap electrode (not shown in FIG. 7) can be slotted (e.g., in the manner of endcap 306 in FIG. 1A), and connected to external leads as mentioned above.

The system 700 can be integrated into and/or implemented in a variety of devices, systems, and/or applications, such as a commercial buildings, homes, factories and the like.

Thus there has been disclosed a system comprising a transformer configured to transform a first direct current to a second direct current. In a preferred embodiment, the transformer comprises a chamber 200, 300, configured to contain plasma, at least two input electrodes 304 disposed at least partially within the chamber 200, 300 and configured to direct the direct current to induce a motion in the plasma, thereby generating the second direct current in the secondary (e.g., including electrode 306), at least two output electrodes extending from the chamber and configured to conduct the second direct current from the chamber, and an electrical delivery network (including, e.g., leads 308) electrically coupled to the at least two output electrodes and configured to conduct the second direct current to at least one remote location. Each of the at least two input electrodes preferably comprise at least one helically-shaped portion.

The chamber 300 preferably includes an integral end cap 307 and a split electrode 306 at opposite ends of the chamber, and wherein the split electrode 306 conveys direct current from the chamber. The at least two input electrodes include at least two sets of paired electrodes equally spaced around the chamber.

In a preferred embodiment, the transformer assembly further includes a solenoid disposed around at least a portion of an external wall of the chamber 200, and an electric current passing through the solenoid induces a magnetic field within the chamber in the axial direction of the solenoid. Induced motion in the plasma distorts the magnetic field, thereby generating a direct current within the chamber. It is immediately understood by a person skilled in the art that the system can be operated in a reciprocal mode, wherein the output and input electrodes are interchanged in function, converting a step up transformer to a stepdown transformer and vice-versa.

Figure 8:
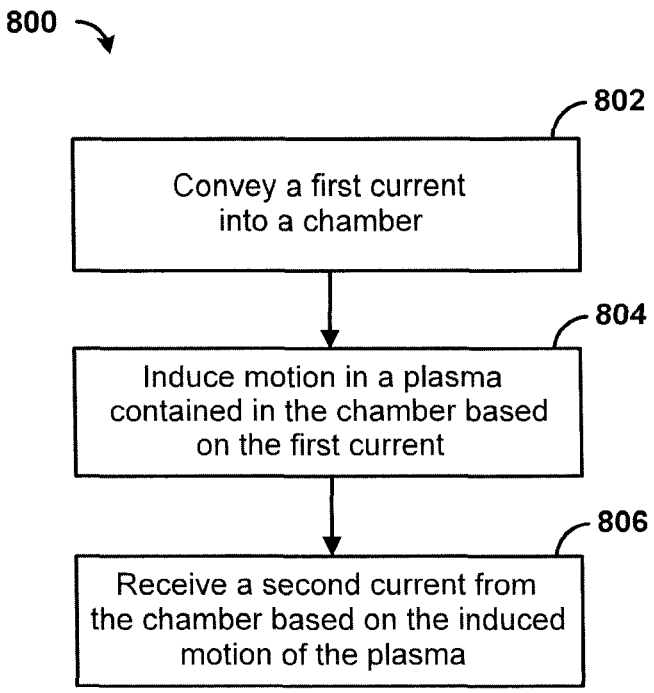
FIG. 8 is a flow chart illustrating an exemplary method for transforming an electrical current.

Attention is advanced to FIG. 8, providing a flow chart illustrating an example method 800 for transforming and/or converting a voltage and/or an electrical current. At step 802, a first current can be conveyed (e.g., provided, carried, received, channeled) into a chamber. The first current preferably is a direct current. The first current can comprise a first voltage. For example, the first current can be conveyed to the chamber from a component of a power plant, power station, power line, and/or the like. The first current can be conveyed into the chamber via two or more electrodes (e.g., two, four, six, eight, being one, two, three or four, etc., sets of electrodes). The two or more electrodes preferably are disposed at least partially within the chamber. For example, the two or more electrodes can each comprise a first portion extending outside of the chamber and a second portion within the chamber. The first current can be through helical electrodes or, in another aspect, through the split electrodes.

The chamber preferably contains a gas, plasma, and/or the like. For example, the chamber can be filled with a gas, such as argon or hydrogen. The gas can be converted to plasma before, at the time of, or after the first current is conveyed to the chamber. The plasma and/or gas can be filled to a specified pressure (e.g., 1 mtorr) to achieve a desired behavior (e.g., motion) of the plasma and/or gas. The chamber can be configured (e.g., shaped, including the length or ratio of diameter to length) to cause, direct, constrain, control, and/or the like motion of the plasma within the chamber. For example, the chamber preferably is cylindrically shaped.

According to the system and method, a magnetic field is generated through the plasma. For example, a conductor wire proximate to the chamber can generate a magnetic field. The wire, which preferably defines a solenoid, can be disposed (e.g., wrapped) around an exterior wall of the chamber. In an aspect, a protective layer (e.g., cover, shroud) can be disposed in between the wire and the chamber, as suggested by FIG. 2.

At step 804 of FIG. 8, motion can be induced in a plasma contained within the chamber based on the first current. For example, the first current can generate a second magnetic field within the chamber. The second magnetic field is based on the path of the first current. For example, the two or more electrodes can be disposed, shaped, or the like, to generate an electric field between at least two of the one or more electrodes. In an aspect, the electric field can be a helically symmetric electric field. For example, the electric field can be rotated along the axis of the chamber. The electric field causes, at least in part, the second current and/or the second voltage to be generated within the chamber.

Inducing the motion in the plasma distorts the magnetic field, thereby inducing a second current within the chamber. Inducing motion in the plasma can include a step of providing the first current through at least one, preferably at least two, helical electrodes within the chamber. The induced motion preferably comprises rotation sheared in an axial direction relative to the plasma. Induced motion can comprise a differential rotation in the plasma. The induced motion may comprise a turbulent flow, a laminar flow, or a combination thereof. For example, the motion can be along a first direction at the center of the chamber, and along a second direction along interior walls of the chamber. The second direction of motion can be opposite the first direction. The first direction and the second direction of motions can be directions along (e.g., parallel to) the axis of the chamber.

At step 806, the second current can be received from the chamber, based on the induced motion of the plasma. The second current preferably is a DC current, transformed relative to the first (input) DC current. As an illustration, the first current can comprise a direct current at one voltage, and the second current can comprise a direct current at a second different voltage.

The second current can be generated in an axial direction (e.g., along an axis or length of the chamber). For example, the second current can be generated along a line extending from a top (e.g., top cap) of the chamber to a bottom (e.g., bottom cap) of the chamber.

Furthermore, the first current can be conveyed with a first voltage. The second current can be conveyed with a second voltage. The second voltage can be a high voltage or low voltage in comparison to the first voltage. For example, the second voltage can be X (e.g., 1 2, 3, 4, 5, etc.) orders of magnitude greater or less than the first voltage.

In an alternative mode of operation, the endcap electrodes and leads serve as the input and the helical electrodes and leads serve as the output; this embodiment may function to convert a "stepup" transformer to a "stepdown" transformer, or vice-versa.

Thus there also has been disclosed herein a method comprising the basic steps of (a) conveying a direct current into a chamber; (b) inducing motion in a plasma contained in the chamber based on the direct current; and (c) receiving a direct current from the chamber based on the induced motion of the plasma. The method preferably further comprises the step of generating a magnetic field through the plasma, and wherein inducing the motion in the plasma distorts the magnetic field, thereby effectuating a step of inducing the direct current within the chamber. The step of inducing motion in the plasma preferably comprises providing the direct current through at least two helical electrodes within the chamber. Also, inducing motion may comprise inducing a rotation sheared in an axial direction relative to the plasma, and wherein generating the direct current comprises generating current in the axial direction.

The step of conveying a direct current preferably comprises conveying with a first voltage, and further comprising a step of conveying the direct current with a second voltage. Also in the method, a split electrode preferably converts the axial currents in the chamber to a direct current. Multiple pairs of primary electrodes may be connected through an external rotor, and the primary electrodes convert axial currents in the chamber to a direct current. The step of inducing motion preferably comprises generating a turbulent flow, a laminar flow, or a combination thereof. Also, inducing motion may comprise inducing a differential rotation in the plasma.

The foregoing examples are offered so as to provide those of ordinary skill in the art with a further disclosure and description of how the compounds, compositions, articles, devices and/or methods claimed herein are made and evaluated, and are intended to be purely exemplary and are not intended to limit the scope of the methods and systems. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This is true for any possible non-express basis for interpretation, including: matters of logic with respect to arrangement of steps or operational flow; plain meaning derived from grammatical organization or punctuation; the number or type of embodiments described in the specification.

Various publications are referenced hereinabove. The disclosures of these publications in their entireties are hereby incorporated by reference into this application in order to more characterize the state of the art to which the methods and systems pertain.

It will be apparent to those skilled in the art that various modifications and variations can be made without departing from the scope or spirit of the disclosed invention. Other embodiments will be apparent to those skilled in the art from consideration of the specification and practice disclosed herein. It is intended that the specification and examples be considered as exemplary only, with the scope of the invention being defined by the claims appended hereto.

What is claimed is:

1. An apparatus comprising:

a chamber configured to contain plasma;

at least two input electrodes disposed at least partially within the chamber and configured to receive a first direct current into the chamber, wherein the at least two input electrodes are configured to direct the first direct current to induce motion in the plasma, thereby to transform the first direct current; and at least two output electrodes extending from the chamber, wherein the at least two output electrodes are configured to conduct a second direct current from the chamber based on the induced motion in the plasma.

2. The apparatus of claim 1, wherein the at least two input electrodes are equally spaced around the chamber.

3. The apparatus of claim 1, wherein the chamber comprises an end cap and a split electrode disposed at opposite ends of the chamber, and wherein all output leads of the at least two output electrodes are disposed through the split electrode.

4. The apparatus of claim 1, wherein the chamber comprises split end cap electrodes disposed at both ends of the device and wherein all output leads of the at least two output electrodes are disposed through the two split electrodes.

5. The apparatus of claim 1, further comprising a solenoid disposed around at least a portion of an external wall of the chamber, wherein an electric current passing through the solenoid induces a magnetic field within the chamber in an axial direction of the solenoid.

6. The apparatus of claim 5, wherein the magnetic field is caused by the induced motion to align at least in part with magnetic fields caused by at least a portion of the at least two input electrodes, thereby inducing the second direct current within the chamber.

7. The apparatus of claim 5, further comprising a protective cover disposed between the solenoid and the chamber.

8. The apparatus of claim 1, wherein the at least two input electrodes comprise at least two direct current input electrodes.

9. A method comprising:

conveying a first direct current into a chamber;

inducing motion in a plasma contained in the chamber based on the first direct current; and receiving a second direct current from the chamber based on the induced motion of the plasma.

10. The method of claim 9, further comprising generating a magnetic field through the plasma, and wherein inducing the motion in the plasma distorts the magnetic field thereby inducing the second direct current within the chamber.

11. The method of claim 9, wherein inducing motion in the plasma comprises providing the first direct current through at least two helical electrodes within the chamber.

12. The method of claim 9, wherein inducing motion comprises inducing a rotation sheared in an axial direction relative to the plasma, and wherein the second direct current is generated in the axial direction and flows out of the chamber through output electrodes.

13. The method of claim 9, wherein conveying a first direct current comprises conveying with a first voltage, and further comprising conveying the second direct current with a second voltage.

14. The method of claim 9, wherein inducing motion comprises generating a turbulent flow, a laminar flow, or a combination of turbulent and laminar flows in the plasma.

15. The method of claim 9, wherein inducing motion comprises inducing a differential rotation in the plasma.

16. A system comprising a transformer configured to transform a first direct current to a second direct current, the transformer comprising, a chamber configured to contain plasma;

at least two input electrodes disposed at least partially within the chamber and configured to direct the first direct current to induce motion in the plasma, thereby generating the second direct current;

at least two output electrodes extending from the chamber and configured to conduct the second direct current from the chamber; and an electrical delivery network electrically coupled to the at least two output electrodes and configured to conduct the second direct current to at least one remote location.

17. The system of claim 16, wherein each of the at least two input electrodes comprises at least one helically shaped portion.

18. The system of claim 16, wherein the chamber comprises an end cap and a split electrode disposed at opposite ends of the chamber, and wherein the split electrode conveys the second direct current from the chamber.

19. The system of claim 16, wherein the at least two input electrodes comprise at least two sets of electrodes equally spaced around the chamber.

20. The system of claim 16, wherein the transformer further comprises a solenoid disposed around at least a portion of an external wall of the chamber, and wherein an electric current passing through the solenoid induces a magnetic field within the chamber in an axial direction of the solenoid.

21. The system of claim 16, wherein the induced the motion in the plasma distorts the magnetic field thereby generating the second direct current within the chamber which exits through the output electrodes.

22. The system of claim 16, wherein the output and input electrodes are reversible in function, thereby converting a stepup transformer to a stepdown transformer or converting a stepdown transformer to a stepup transfer.

* * * * *